United States Patent [19]

Besecker

[11] 4,300,369

[45] Nov. 17, 1981

[54] PROTECTIVE ENCLOSURE FOR A PADLOCK

[76] Inventor: Kenneth H. Besecker, 191 Vistawood La., Marietta, Ga. 30066

[21] Appl. No.: 940,438

[22] Filed: Sep. 7, 1978

[51] Int. Cl.[3] ..... E05B 67/38

[52] U.S. Cl. ..... 70/54; 70/56

[58] Field of Search ..... 70/52, 54, 55, 56, 417, 70/423, 2–13; 292/281

[56] References Cited

U.S. PATENT DOCUMENTS

| | | | |
|---|---|---|---|
| 3,765,197 | 10/1973 | Foote | 70/58 |
| 3,903,721 | 9/1975 | Aaron | 70/423 |
| 4,094,177 | 6/1978 | Wellekens | 70/423 |

*Primary Examiner*—Robert L. Wolfe

*Attorney, Agent, or Firm*—Jones, Thomas & Askew

[57] ABSTRACT

A protective enclosure for a padlock so as to preclude line-of-sight access to the padlock. The enclosure comprises a box shaped housing which includes an access opening formed in one wall and a shackle opening formed diagonally opposite the access opening in another wall of the housing. A rigid inner partition protrudes perpendicularly from the wall in which the access opening is formed, so as to block the line of sight between the access opening and the body portion of a padlock positioned with its shackle extending through the shackle opening.

2 Claims, 3 Drawing Figures

PROTECTIVE ENCLOSURE FOR A PADLOCK

BACKGROUND OF THE INVENTION

A padlock which is easily accessable is very susceptible to being broken into. The lock can be beaten with heavy objects or pried apart, or else it can be opened with readily available master keys or otherwise rendered ineffective by any number of methods. Various prior art devices have partially addressed the problem by protecting the padlock from damaging blows and from prying. U.S. Pat. Nos. 3,718,014 and 3,736,016 are good examples of such prior art protective devices. These prior art devices enclose the body portion of the padlock within a housing and prevent direct assault on the padlock by hammers or other heavy objects. The patented devices do, however, leave easy access to the body portion of the padlock for insertion of a key and removal of the padlock.

The problem addressed by the present invention arises from the fact that there are more ways to break a lock than by smashing and prying. Master keys are in existence for almost every make of padlock. By simply knowing the make of the padlock, a burglar can acquire a series of master keys and eventually undo the padlock. Also, if a burglar has access to the keyhole of the padlock, he can inject freon through the keyhole into the body of the padlock to freeze the locking components and make them brittle, after which a slight tap on the body of the padlock will shatter the locking mechanism thus freeing the shackle.

SUMMARY OF THE INVENTION

Briefly described, the present invention comprises a housing into which the padlock is received and through which the padlock shackle protrudes for attachment to the lock half, so that the body of the padlock is shrouded from view. Stated somewhat more particularly, the housing of the invention includes a partition built up within the housing to prevent any direct line of sight access to the padlock. A burglar, as well as any user, cannot see the padlock in order to discover the make of the padlock. Access can only be had to the padlock by bending one's hand around the partition of the housing. Therefore, insertion of the proper key into the back of the padlock can be accomplished with some minor difficulty since an authorized user obviously can be expected to know which key opens the lock. The present invention makes access to the body portion of the padlock very difficult and thereby discourages the use of freon injecting devices or other damaging objects. The restricted accessability of the padlock lessens the opportunities of picking or other unauthorized removal of the padlock and, therefore, entry to the protected area. The invention accomplishes this protection by shrouding the lock from view, and is particularly applicable for use on swinging gates and doors. Also, with modifications, it can be adapted to be utilized on sliding doors and sliding gates, and in other applications where a padlock is typically used with a conventional hasp. The protective enclosure of the present invention protects locks from being picked, from being cut by bolt cutters, from being beaten with a hammer and from jimmying.

It is therefore an object of the present invention to provide a protective enclosure for a padlock which prevents observation of the padlock within the enclosure.

Another object of the present invention is to provide a protective enclosure for a padlock which provides difficult and even tortuous access to the padlock.

Other objects, features and advantages of the present invention will become apparent upon reading the following specification, when taken in conjunction with the accompanying drawings.

DETAILED DESCRIPTION

Figure 1:
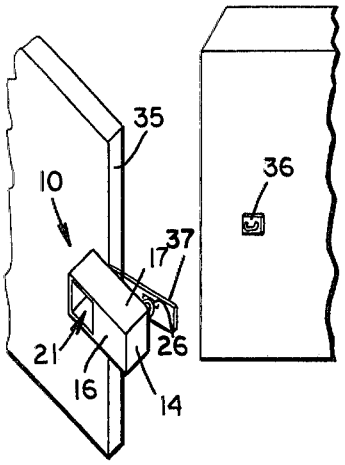
FIG. 1 is a pictorial view of the protective enclosure according to an embodiment of the present invention, mounted for use on a swinging door.
Figure 3:
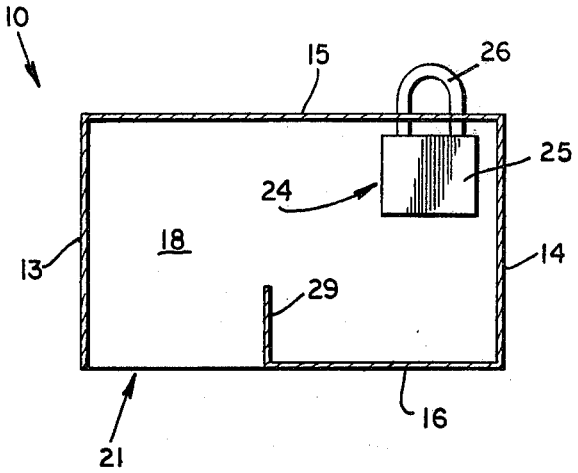
FIG. 3 is a top view of the protective enclosure taken along line 3—3 of FIG. 1.
Figure 2:
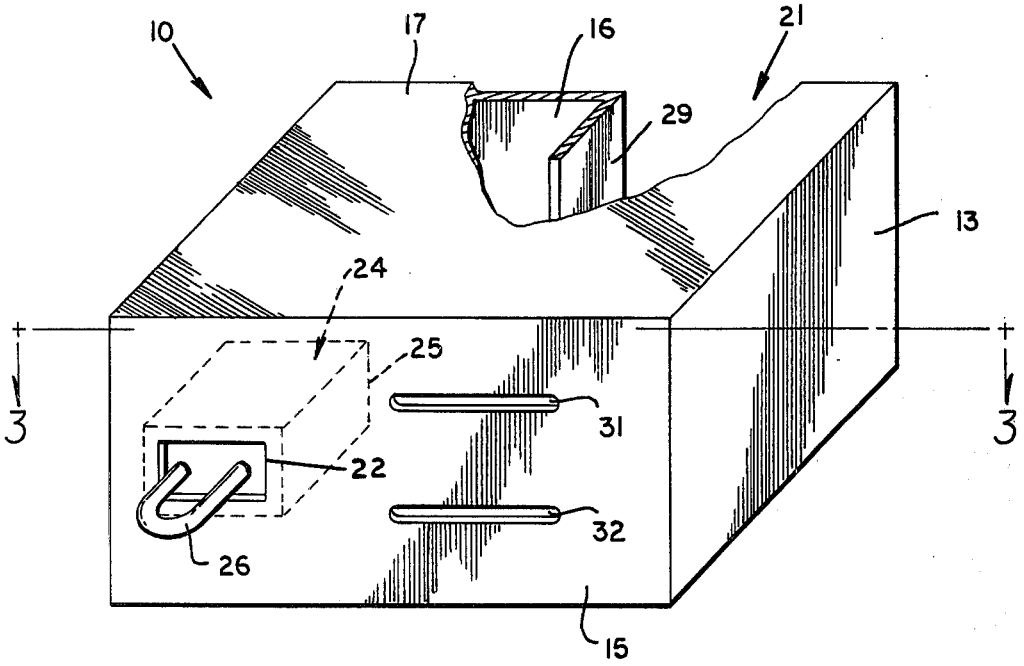
FIG. 2 is a partially broken-away pictorial view of the protective enclosure of FIG. 1 with a padlock positioned therein.

Referring now in more detail to the drawings in which like numerals represent like components throughout the several views, FIG. 1 shows the protective enclosure 10 of the present invention in use on a swinging door. The protective enclosure 10 comprises a box shaped housing which includes two opposing end walls 13, 14, a front wall 15, a back wall 16, a top wall 17 and a bottom wall 18. A large opening 21, also known as the access opening, is formed in the back wall 16 adjacent one end wall 13. A smaller opening 22, also known as the shackle opening, is formed in the front wall 15 of the housing opposite one end of the back wall diagonally opposite from the access opening 21, that is, adjacent the side wall 14. The shackle opening 22 is large enough to accept the shackle 26 of a padlock 24 through the opening, and the opening is small enough to prevent the body portion 25 of the padlock from pulling through the shackle opening. Also formed in the front wall 15 of the housing 12 are two elongated slots 31 and 32. A rigid inner partition 29 is attached to the back wall 16 adjacent the access opening 21 and protrudes into the housing perpendicular to the back wall 16. The inner partition 29 extends only partially across the housing between the back wall 16 and the front wall 15. The inner partition 29 extends far enough across the housing between the front and back walls 15, 16 to block line of sight access between the access opening 21 and the body portion 25 of the padlock 24 when the padlock is in position with its shackle 26 protruding from the shackle opening 22.

In operation, the protective enclosure 10 is preferably, although not necessarily, fastened by bolts or other fastening devices extending through the elongated slots 31 and 32 to a swinging or sliding door or gate 35. The padlock 24 is placed within the housing 12 with the open shackle 26 extending through the shackle opening 22. The swinging door 35 is then closed and the shackle 26 is looped around the lock staple 36 and locked within the body portion 25 of the padlock 24. The protective enclosure 10, although it can be attached to the door, is not intended to replace the hasp 37 which ordinarily is associated with the lock system. Of course, if desired, the enclosure 10 could be used to replace the hasp 37. With the protective enclosure 10 in the presently described arrangement, the padlock 24 can only be reached through the access opening 21 and then only by reaching around the rigid inner partition 29. The body portion 25 of the padlock 24 cannot be seen through the access opening 21 because the inner partition 29 blocks the line of sight between the access opening 21 and the padlock body portion 25. Accordingly, any unauthorized person who wants to open the padlock 24 with a pick or some other expedient cannot determine the type of lock from visual insertion, and can at best use only one hand to gain access to the padlock. It will be practically impossible to use a pick in such circumstances, or to direct a stream of freon into the keyhole of the padlock. Persons who are authorized to open the padlock obviously have the proper key, and will be able to open the padlock by inserting one hand through the access opening 21 and around the partition to locate the keyhole by feel.

The dimensions of the enclosure 10 should be such that a hand can be inserted through the access opening 21 and manuvered through the housing 12 to position the padlock 24 and to manipulate a key to unlock the padlock. The enclosure 10 should be small enough for practical use on a swinging door and small enough to prevent the effective manuvering of potentially dangerous objects through the access opening 21 and around the inner partition 29 into contact with the padlock 24. The inner partition 29 should be of a size which will block the line of sight from access opening 21 to the padlock body portion 25 and will create a "tortuous" path of access to the padlock body portion.

The dimensions of a working embodiment of the present invention, by which the invention is not to be limited, are as follows: end walls 13, 14 are 6 and $\frac{1}{4}$ inches wide and 5 and $\frac{1}{2}$ inches high; front and back walls 15, 16 are 11 inches long; the access opening 21 is 5 inches long and 5 and $\frac{1}{2}$ inches high; the inner partition 29 is 5 and $\frac{1}{2}$ inches high and 2 inches wide; the shackle opening 22 is 2 and $\frac{1}{4}$ inches long and 1 inch high and is positioned 1 inch away from end wall 14 and 2 inches above bottom wall 18.

While this invention has been described in specific detail with particular reference a preferred embodiment, it will be understood that variations and modifications can be effected within the spirit and scope of the invention as described herein before and as defined in the appended claims.

What is claimed is:

1. A protective enclosure for use with an existing padlock or the like, comprising:

means for defining a receptacle having an internal chamber for receiving the body of a padlock, said receptacle having means to permit a latching portion of the padlock to extend out of said internal chamber;

said receptacle having an opening for gaining access to said chamber so as to unlock said padlock; and said receptacle having means to define a tortuous path through said opening and into said chamber operative to block line-of-sight access to the keyhole of the padlock within said chamber while leaving the keyhole unobstructed for manual access.

2. A protective enclosure for a padlock of the type having a body portion and a shackle extending from the body portion, comprising:

a housing for receiving the body portion of a padlock;

said housing having a shackle opening which permits the shackle of the padlock to extend outside of said housing so as to engage a locking member;

means for retaining the padlock within said housing so that said body portion cannot be removed from the housing through said shackle opening, said housing having an access opening through which said padlock is accessible for the purpose of unlocking; and means for defining a tortuous path between said access opening and the body portion of a padlock which is shackled through said shackle opening, so as to permit unlocking access to said padlock without providing a line-of-sight access to said padlock from said access opening;

said housing comprising a first wall and a second wall opposite said first wall; said shackle opening being formed in said first wall at one end of said first wall and said access opening being formed in said second wall at an end of said second wall diagonally opposed to said one end of said first wall; and said means defining a tortuous path between said access opening and the body portion of a padlock which is shackled through said shackle opening; comprising a partition protruding from said second wall adjacent said access opening blocking the line of sight path between said access opening and the body portion of the padlock when the shackle is extending through the shackle opening.

* * * * *